US010100573B2

(12) United States Patent
Mendoza et al.

(10) Patent No.: US 10,100,573 B2
(45) Date of Patent: Oct. 16, 2018

(54) NATURAL GAS VEHICLE MAINTENANCE SEPARATION AND CONTAINMENT SYSTEM

(71) Applicant: Clean Energy Fuels Corp., Newport Beach, CA (US)

(72) Inventors: Rick Mendoza, Pico Rivera, CA (US); Sheldon Canonizado, West Covina, CA (US); Ricardo Zagal, Los Angeles, CA (US); Evan W. Chandler, Tustin, CA (US); Michael J. LeBrun, Yorba Linda, CA (US)

(73) Assignee: Clean Energy Fuels Corp., Newport Beach, CA (US)

( * ) Notice: Subject to any disclaimer, the term of this patent is extended or adjusted under 35 U.S.C. 154(b) by 495 days.

(21) Appl. No.: 14/480,409

(22) Filed: Sep. 8, 2014

(65) Prior Publication Data

US 2016/0069124 A1 Mar. 10, 2016

(51) Int. Cl.

| | |
|---|---|
| ***E06B 5/14*** | (2006.01) |
| ***E06B 3/80*** | (2006.01) |
| *E04H 6/42* | (2006.01) |

(52) U.S. Cl.

CPC ..... *E06B 5/14* (2013.01); *E06B 3/805* (2013.01); *E04H 6/42* (2013.01)

(58) Field of Classification Search

CPC ... E04H 6/42; E05D 15/0643; E05D 15/0652; E06B 5/14

See application file for complete search history.

(56) References Cited

U.S. PATENT DOCUMENTS

| | | | | |
|---|---|---|---|---|
| 2,911,038 A * | 11/1959 | Frommelt | ..... | A61F 9/06 160/351 |
| 3,016,951 A * | 1/1962 | Greene | ..... | E06B 3/805 160/126 |
| 3,331,425 A * | 7/1967 | Groves | ..... | E06B 3/80 160/113 |
| 3,421,568 A * | 1/1969 | Youngs | ..... | E06B 9/174 160/267.1 |

(Continued)

OTHER PUBLICATIONS

NGV Easy Bay, publicly available at https://www.cleanenergyfuels.com/wp-content/uploads/2014/10/NGV-Easy-Bay-One-Pager_Final.pdf on or before Oct. 14, 2014 as verified by www.web.archive.org, published by Clean Energy, two page document, downloaded on Sep. 6, 2016.*

(Continued)

*Primary Examiner* — Katherine W Mitchell
*Assistant Examiner* — Johnnie A Shablack
(74) *Attorney, Agent, or Firm* — Sheppard, Mullin, Richter & Hampton LLP

(57) ABSTRACT

A separation and containment system is provided. The separation and containment system can contain natural gasses, e.g., compressed natural gas (CNG) and liquefied natural gas (LNG), within a natural gas vehicle (NGV) service area, and separate the NGV service area from a conventional service area. The separation and containment system utilizes one or more barriers, such as industrial fabric/vinyl materials that meet various regulatory safety standards applicable to NGVs. The separation and containment system is easily constructed, dismantled, and resized/adapted in accordance with desired operating conditions.

11 Claims, 6 Drawing Sheets

(56) References Cited

U.S. PATENT DOCUMENTS 3,583,465 A * 6/1971 Youngs ..... A47G 5/02 160/243
3,798,839 A * 3/1974 Kaufman ..... E05D 15/0613 160/199
4,194,550 A * 3/1980 Hopper ..... A47H 23/06 160/107
4,232,725 A * 11/1980 Gidge ..... E06B 3/80 160/332
4,285,095 A * 8/1981 Janson ..... A47H 1/04 16/94 R
4,289,190 A * 9/1981 Catan ..... E06B 3/80 160/184
4,390,585 A * 6/1983 Holden ..... D06N 3/06 427/209
4,449,270 A * 5/1984 Brabant ..... E06B 3/80 16/87.4 R
4,582,109 A * 4/1986 Fairbanks ..... A47H 13/14 160/348
4,943,110 A * 7/1990 Pastva ..... B60J 5/065 16/104
5,149,582 A * 9/1992 LaMarca, II ..... A47C 7/26 156/148
5,188,186 A * 2/1993 Nash ..... A62C 2/10 160/40
5,301,479 A * 4/1994 Romig ..... B65D 90/24 160/133
5,383,510 A * 1/1995 Allen ..... A62C 2/10 160/243
5,429,171 A * 7/1995 Hamilton ..... E06B 9/64 160/122
5,450,889 A * 9/1995 Jones ..... A47H 15/02 160/330
5,899,303 A * 5/1999 Allen ..... B66B 13/30 160/118
5,994,242 A * 11/1999 Arthurs ..... B32B 27/12 442/102
6,394,171 B1 * 5/2002 Robbins, III ..... E06B 3/80 160/184
6,813,863 B2 * 11/2004 Duffy ..... E04B 9/008 160/330
7,000,668 B2 * 2/2006 Sears ..... E06B 9/13 160/2
7,389,610 B1 * 6/2008 McMakin ..... E06B 5/12 110/173 R
7,818,941 B2 * 10/2010 Freudenberg ..... E04G 21/30 160/405
8,359,681 B2 * 1/2013 Hotaling ..... E04H 4/06 4/498
8,365,804 B1 * 2/2013 Genovese ..... E06B 3/80 160/351
8,667,690 B2 * 3/2014 Cajiga ..... B60S 5/02 29/897.3
8,684,067 B1 * 4/2014 Frame ..... H05K 7/1497 160/330
2003/0051829 A1 * 3/2003 Sears ..... E06B 9/13 160/243
2004/0058603 A1 * 3/2004 Hayes ..... B32B 27/12 442/286
2005/0166434 A1 * 8/2005 Barlow ..... G09F 21/18 40/610
2008/0115896 A1 * 5/2008 Goodman ..... E05D 15/26 160/199
2008/0120913 A1 * 5/2008 Lagares Corominas ..... E05B 65/001 49/449
2010/0056311 A1 * 3/2010 Kondash ..... E05F 15/684 474/136
2010/0299871 A1 * 12/2010 Kondash ..... E06B 3/481 16/91
2011/0024061 A1 * 2/2011 Bell ..... E05D 15/0652 160/199
2011/0226425 A1 * 9/2011 Forbis ..... E04B 1/80 160/127
2013/0008620 A1 * 1/2013 Cusick ..... B05B 15/0456 160/372
2013/0014907 A1 * 1/2013 Garrett, III ..... E05D 15/0652 160/201
2013/0092330 A1 * 4/2013 Robbins, III ..... E06B 3/80 160/332
2013/0152493 A1 * 6/2013 Karisch ..... E04H 6/426 52/174
2014/0127451 A1 * 5/2014 Pilpel ..... B32B 5/12 428/113
2014/0173992 A1 * 6/2014 Baumert ..... E06B 1/70 49/470
2014/0345811 A1 * 11/2014 McDaniel ..... E06B 9/24 160/188
2014/0360688 A1 * 12/2014 Forbis ..... E04B 1/80 160/405
2015/0361714 A1 * 12/2015 Derode ..... E06B 5/125 160/3

OTHER PUBLICATIONS

PVC Coated Polyester Reinforced Fabrics, publicly available at http://www.tmipvc.com/pvccoatedvinyl.html on or before Apr. 2, 2012 as verified by www.web.archive.org, published by TMI, LLC, two page document, downloaded on Dec. 4, 2016—referred to as TMI in rejection.*

Custom ClearView Panels, publicly available at https://www.farmtek.com/farm/supplies/prod1;ft_canopies_tents;pg105657.html on or before Aug. 3, 2014 as veriied by www.web.archive.org, published by FarmTek, two page document, downloaded on Dec. 4, 2016—referred to as Farmtek in rejection.*

AmCraft Manufacturing Inc., Curtain Track and Track Hardware Specifications, Mar. 25, 2013, <http://amcraftindustrialcurtainwall.com/wp-content/uploads/2017/06/Galvanized-Steel-Track-Hardware-Specifications.pdf> (Year: 2013).*

Steel Guard, "Auto Guard Automotive Curtain," <https://www.steelguardsafety.com/auto-guard-automotive-curtains> (Year: 2013).*

Akon, LLC "Garage Divider Curtain," <https://www.curtain-and-divider.com/industrial-curtain-track-hardware/> (Year: 2013).*

Arnold, Steve and Jeff Lamoureux, "Natural Gas Vehicle Maintenance Facilities", ET environmental. Accessed from <http://www.stateenergyoffice.wi.gov/docview.asp?docid=24887>. (Year: 2013).*

Thomason, Leo, "Facitilites Modification for Natural Gas Vehicles," Natural Gas Vehicle Institute. Accessed from <http://www.ngvi.com/Documents/FacilitiesModificationforNaturalGasVehiclesPaper.pdf>. (Year: 2013).*

NFPA, "Vehicular Gaseous Fuel Systems Code." Accessed from <http://files.dep.state.pa.us/OilGas/BOGM/BOGMPortalFiles/Act13/NGVProgram/NFPA_52_2010_Vehicular_Gaseous_Fuel_Systems.pdf>. (Year: 2010).*

Wisconsin State Energy Office, "Natural Gas for Transportion Vehicle Repair Garage Guidelines." Accessed from <http://www.rrc.state.tx.us/media/4741/ngvgarageguidelines.pdf>. (Year: 2013).*

Fortis BC, "Safety Upgrades for Maintenance Facilities Servicing Commerical Fleet CNG/LNG Vehicles." <https://www.fortisbc.com/NaturalGas/Business/NaturalGasVehicles/Howwecanhelp/Incentives/MaintenanceFacilityUpgradeIncentives/Documents/GuidlineNGTMaintenanceFacilityUpgradeGuideline_July_4_2013.pdf>. (Year: 2013).*

Steel Guard, "Industrial Curtains." <https://www.steelguardsafety.com/industrial-safety-curtain-products>. (Year: 2014).*

* cited by examiner

NATURAL GAS VEHICLE MAINTENANCE SEPARATION AND CONTAINMENT SYSTEM

TECHNICAL FIELD

Various embodiments relate to natural gas vehicles, and more particularly, to a separation and containment system for maintenance areas where such natural gas vehicles may be serviced.

DESCRIPTION OF THE RELATED ART

A natural gas vehicle (NGV) can refer to some form of vehicle that may operate using natural gas for fuel, e.g., compressed natural gas (CNG) or liquefied natural gas (LNG) as a cleaner alternative to other fossil fuels, e.g., gasoline or petrol. Certain statistics indicate that there were 14.8 million NGVs being used in 2011 worldwide. That number continues to increase. NGVs are especially prevalent in regions of the world that have limited access to petroleum-based gasoline/petrol.

Although gasoline-operated vehicles are still the most predominant type of vehicles in the United States, the United States in 2009 had a fleet of 114,270 compressed natural gas (CNG) vehicles, mostly buses, and 3,176 vehicles running on liquefied natural gas (LNG).

As a result of this growth in NGVs, the need for facilities in which NGVs are able to be serviced and maintained is also growing. However, certain conditions may arise that are not necessarily experienced during the servicing of conventional, e.g., gasoline-operated vehicles. Accordingly, there is a need for converting existing maintenance areas into NGV-capable maintenance areas.

BRIEF SUMMARY OF VARIOUS EMBODIMENTS

According to various embodiments of the invention, the following describes a separation and containment system for containing natural gasses and separating an NGV service area from a conventional service area. In some embodiments, the separation and containment system comprises at least one adaptable barrier for containing one or more forms of natural gas. The separation and containment system further comprises a track system to which the at least one adaptable barrier is attached, wherein the track system and the at least one adaptable barrier together delineate a first area configured for servicing NGVs and separating the first area from at least one second area.

BRIEF DESCRIPTION OF THE DRAWINGS

The present invention, in accordance with one or more various embodiments, is described in detail with reference to the following figures. The drawings are provided for purposes of illustration only and merely depict typical or example embodiments. These drawings are provided to facilitate the reader's understanding of various embodiments and shall not be considered limiting of the breadth, scope, or applicability of the present disclosure. It should be noted that for clarity and ease of illustration these drawings are not necessarily made to scale.

Figure 1:
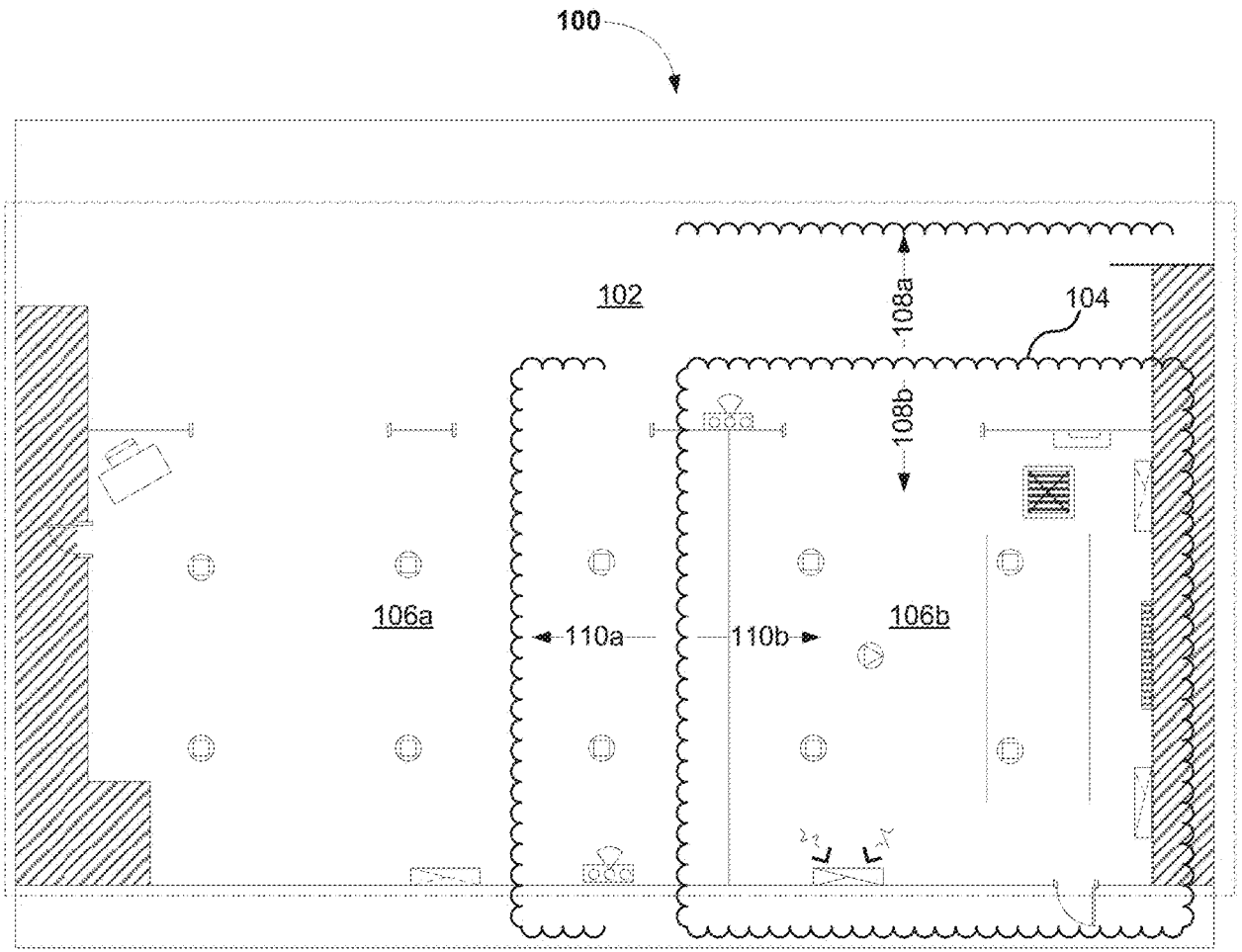
FIG. 1 illustrates an example separation and containment system in accordance with certain aspects of the present disclosure.

The figures are not intended to be exhaustive or to limit the various embodiments to the precise form disclosed. It should be understood that various embodiments can be practiced with modification and alteration, and that the various embodiments may be limited only by the claims and the equivalents thereof.

DETAILED DESCRIPTION OF VARIOUS EMBODIMENTS

Various embodiments are directed to a convenient and easily implemented system for converting an area of a building, e.g., existing service area, into an NGV-compliant service area. This system may also be readily scaled in terms of size to adapt to existing areas, accommodate the servicing of more (or less) NGVs as may be necessitated, etc. In particular, the system implements an easily deployed, retractable containment barrier that can be implemented about an NGV service area.

As alluded to previously, the demand for NGVs has grown. With that growth, the need for modifying, e.g., existing maintenance and repair facilities, to allow them to accommodate NGVs has also increased. Certain codes and regulations have been promulgated by various federal, state, and/or local entities, adherence to which is required in order to allow NGV service in buildings originally constructed to only handle petroleum-based fuels such as gasoline or diesel. One reason for such regulations is that petroleum-based fuels are primarily heavier than air. Natural gas, which is lighter than air, will rise to a ceiling level if a leak were to occur. This is in contrast to the creation of a ground level puddle, which may occur with a petrol fuel.

For example, and as to CNG systems, a basic hazard is the unintended release and ignition of the (compressed) natural gas while an NGV is in a repair facility or garage. By way of example, in the 1990s, some first generation pressure relief devices installed on natural gas cylinders were either improperly designed, or in some cases, were incapable of handling the working pressure of the natural gas in NGVs. In certain instances, this resulted in the premature release of the natural gas cylinder contents. This full release of the natural gas cylinder's contents led to an assumption that a reasonable level of hazard for CNG vehicles comprised a release of 150% of the largest cylinder on an NGV vehicle, the extra 50% being a safety factor. Since pressure relief devices on CNG cylinders were previously designed to only release the fuel in the event of a fire, and not due to pressure increases in the cylinder, a redesign of the pressure relief devices ensued and safety design standards were revised. Still, the quantification of the level of hazard for CNG vehicles is part of an ongoing study, and the potential for an unintended release and/or ignition of CNG must be accounted for from a safety perspective.

As for LNG vehicles, existing codes do not define a specific release scenario. However, two types of releases are assumed as being possible. The basic hazard for LNG systems is the possible ignition of gas released from an LNG tank relief valve due to pressure building as the contents warm over a period of time. Vacuum insulated LNG tanks are generally designed with consideration being given to a "hold time" of up to several days before the pressure builds to the relief valve setting. For example, an LNG tank's pressure can build at a rate of about 15 psig per day resulting in an approximate "hold time" of seven days. Another type of anticipated release is that of a possible liquid LNG release into a service facility.

Existing service facilities that are designed only to handle the maintenance and repair of petrol fuel-based vehicles will unlikely meet the codes/regulations that apply to the maintenance and repair of NGVs. Accordingly, upgrading an entire service facility can involve changes including, but not limited to: ventilation system upgrades; electrical system upgrades; heating system upgrades; adjustments to where vehicle maintenance activities such as welding or grinding can be performed; as well as the addition of methane detection and alarm systems.

Addressing these upgrades using traditional/conventional construction methods can be expensive. Additionally, such upgrades can involve a multitude of changes that may involve, for example, the lowering of all existing electrical components and lighting, replacing heaters, and constructing separation or containment walls/structures. Moreover, and because many of these existing vehicle maintenance garages can be housed and/or implemented in larger buildings with multiple service bays and high ceilings, NGV code compliance upgrades becomes even more expensive and even more onerous.

Not only does the upgrading of existing service facilities entail large costs, but the resulting NGV-compliant maintenance facilities lack scalability. For example, upgrading an entire existing repair garage may be "overkill" in scenarios where the number of NGVs to be serviced may not warrant the upgrading of an entire service facility. As another example, an existing service facility may have a need to service both conventional petroleum-based fuel vehicles as well as NGVs. Accordingly, upgrading an entire facility would also be unnecessary. Furthermore, and to that end, conventional construction methods can require upgrades to an entire contiguous shop area where NGVs will be serviced, again leading to increased cost of upgrading and increased logistical issues.

Referring back to the adjustment of vehicle maintenance activity locations, activities such as welding and grinding must be kept some minimum distance(s) away from areas where NGVs are serviced. Thus, incorporation of an NGV-compliant service area into an existing service garage can even encroach or reduce the amount of area where conventional vehicle service can be provided or conducted. Referring back to the containment and separation aspect, conventional construction methods rely on permanent vapor walls be constructed as a barrier to separate portions of a service facility dedicated to accommodating NGVs from those where conventional vehicles can be serviced. Walls constructed with conventional methods are expensive, and again can negatively affect available working space and complicate the logistics of upgrading a service facility. Additionally still, the use of "traditional" construction materials such as masonry or drywall (with steel or wood framing) provides little to no on-the-fly adjustability of conventional NGV-compliant service areas, as these upgrade techniques rely on, for all intents and purposes, permanent upgrades.

Accordingly, various embodiments provide an easily implementable and scalable/adjustable NGV separation and containment system. The system provides a significantly less expensive option by minimizing "whole shop compliance" using a retractable industrial material that can enclose an NGV service-specific area. This material can act as a containment barrier for upgraded areas, allowing NGV repair and service while avoiding the need to upgrade an entire existing service facility. The system is scalable and easily installed, thereby allowing a portion(s) of an existing building to be upgraded. The system further allows for easy removal or regression back to a conventional service area if ever needed. Additionally still, the upgrading of an existing service facility can occur in (future) stages as may be required to accommodate more NGV-compliant service areas with minor adjustments.

FIG. 1 illustrates an existing building or structure 100. Enclosed within building 100, is an existing service facility 102. Existing service facility 102 can be a service facility for maintaining and repairing petrol fuel vehicles, such as consumer vehicles (e.g., gasoline-operated cars), fleet vehicles such as buses, marine vessels, and the like.

In order to convert or upgrade a portion of existing service facility 102, various embodiments implement a separation and containment barrier 104, such as an industrial fabric barrier, to separate a first service area 106*a* from a second service area 106*b*. First service area 106*a* can remain a conventional service area, while second service area 106*b* can be used as an NGV service area.

As will be discussed in greater detail below, barrier 104 can provide the requisite separation and containment in accordance with applicable codes or regulations with which an NGV service facility may require compliance. Moreover, barrier 104 can work with one or more additional/upgrade appurtenances, such as ventilation elements/equipment to remove or contain any leaked or otherwise present natural gas. That is, barrier 104 may not only separate the second service area 106*b* from the first service are 106*a*, but may contain natural gas within second service area 106*b* until such ventilation equipment can properly and adequately remove/extract the natural gas from second service area 106*b*. Additionally, any contiguous areas such as one or more areas within/part of the first service area can remain in its current state. That is, no upgrades are necessarily required anywhere except within the second service area 106*b*.

As further illustrated in FIG. 1, the size of the second service area 106*b* can be expanded or contracted depending on the needed surface area/floor space to accommodate the second service area 106*b*. For example, barrier 104 can be extended further into the first service area 106*a* (as indicated by arrow 110*a*), further "into" existing service facility 102 (as indicated by arrow 108*a*) or alternatively, retracted further into the second service area 106*b* (as indicated by arrows 108*b* and 110*b*). Although not illustrated, barrier 104 can be adjusted in other directions/dimensions, such as for example, in its height. This can be useful for accommodating buildings having areas with different ceiling heights, sloped or irregularly-shaped ceilings, accommodating dropped areas such as repair pits and the like, etc.

Figure 2:
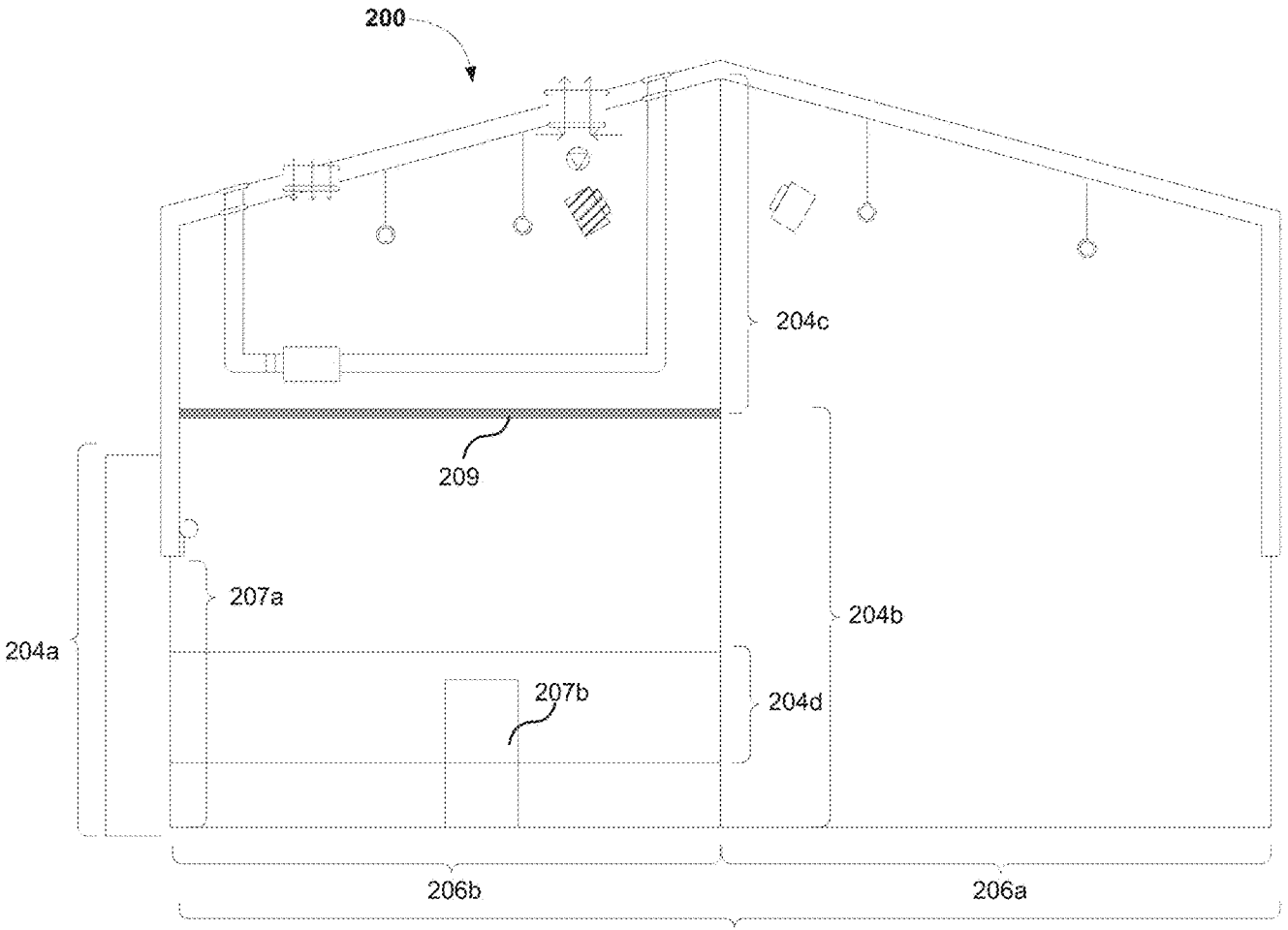
FIG. 2 illustrates another example separation and containment system in accordance with certain aspects of the present disclosure.

FIG. 2 illustrates another example implementation of an NGV separation and containment system in accordance with various embodiments. FIG. 2 illustrates a building or structure 200 that may have enclosed or have built therein, an existing service facility 202. Existing service facility 202 may be partitioned into a conventional service area 206*a* and an NGV service area 206*b* through the use of barriers 204*a*-204*d*. Barrier 204*a* can be a retractable barrier for providing containment about a first entry/doorway 207*a*. Barrier 204*b* can provide separation and containment of NGV service area 206*b* from conventional service area 206*a*. Barrier 204*b* can also be retractable or it can be a static barrier. Barrier 204*c* can be, e.g., a static barrier, for separating, for example, upgraded electrical and HVAC equipment from the remainder of building 200. Entry/doorway 207*b* may be, e.g., an existing/original building exit/entry doorway along a "back" wall of NGV service area 206*b*. In addition, contemplated barriers in accordance with various embodiments can be implemented with a clear, transparent, or like vision panel 204*d*.

Barrier 204*b* can be installed and held in place via a track system 209. Track system 209 can leverage any existing structural support, e.g., roof support structures such as beams and the like. Alternatively, track system 209 can be a dedicated track system to which one or more barriers can be attached.

Figure 3A:
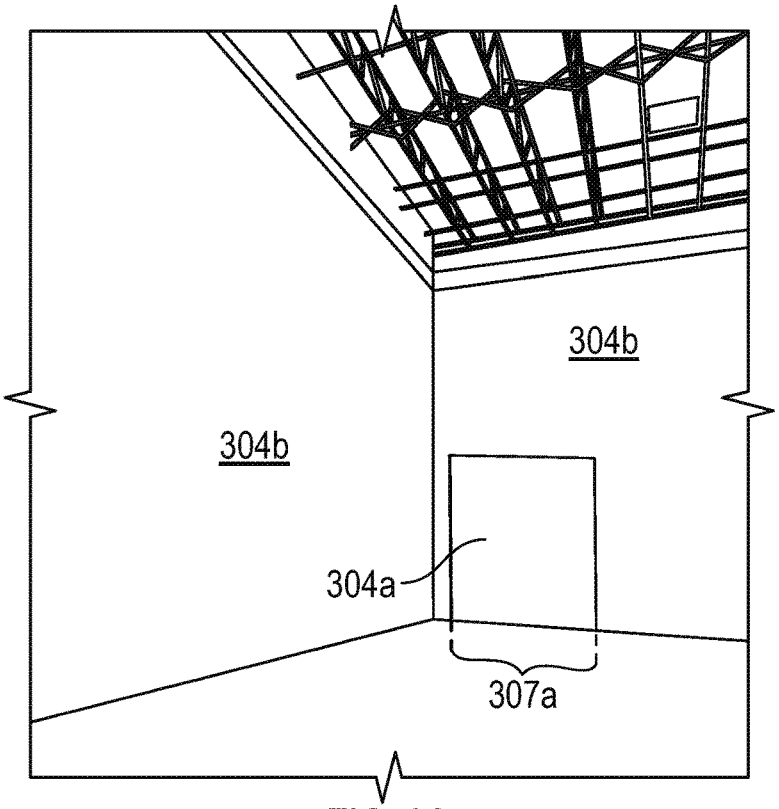
FIGS. 3A and 3B illustrate inner and outer views of an example separation and containment system having a strip door in accordance with certain aspects of the present disclosure.
Figure 3B:
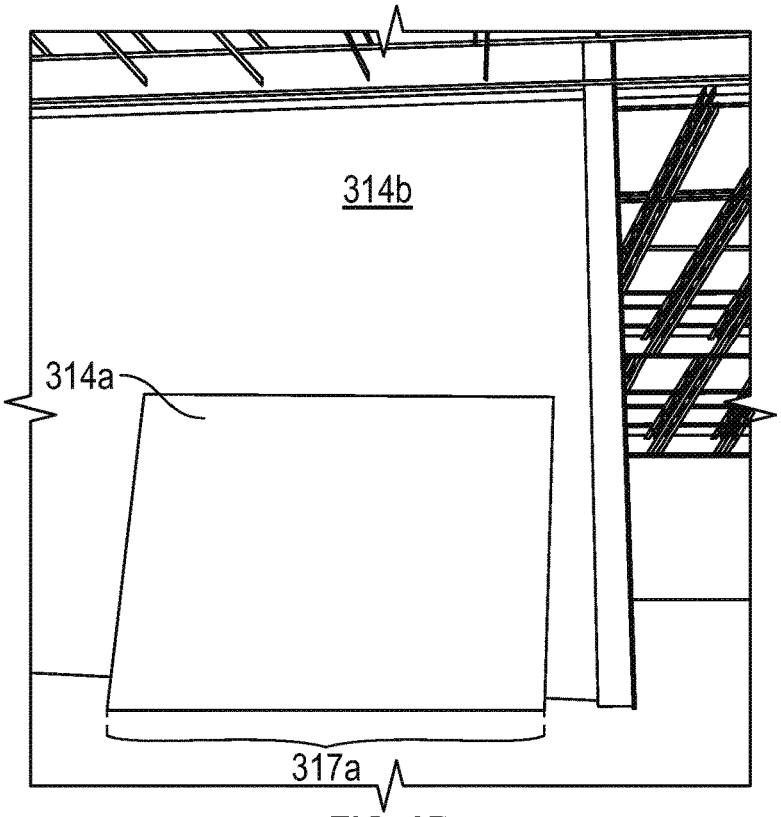

FIG. 3*a* illustrates an interior view of an example NGV service that is separated from an existing service area via, e.g., a door barrier 304*a* that can comprise a "strip" door and a static wall barrier 304*b*. FIG. 3*b* illustrates an exterior view of another example NGV service area that is separated from an existing service area. The NGV service area can be separated and contained via a strip door barrier 314*a* and a static wall barrier 314*b*.

Figure 4A:
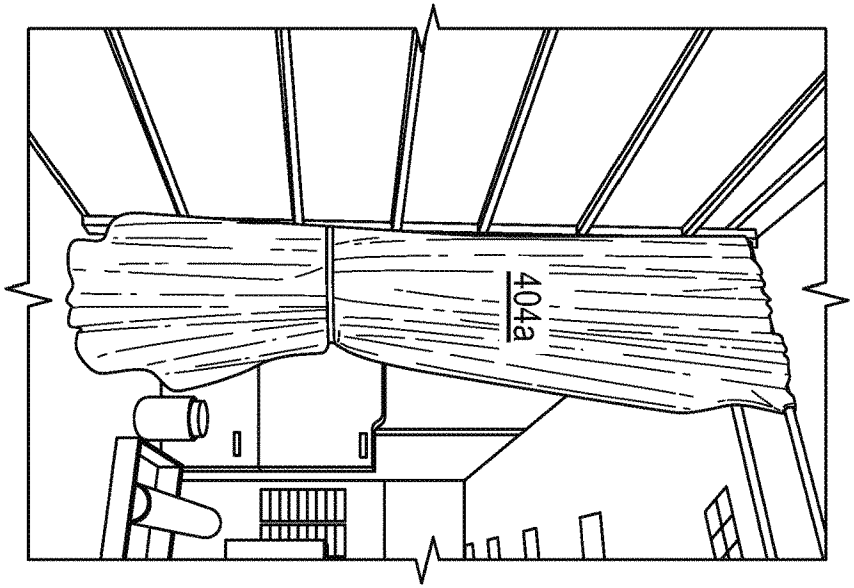
FIG. 4A illustrates a retracted barrier in accordance with certain aspects of the present disclosure.
Figure 4B:
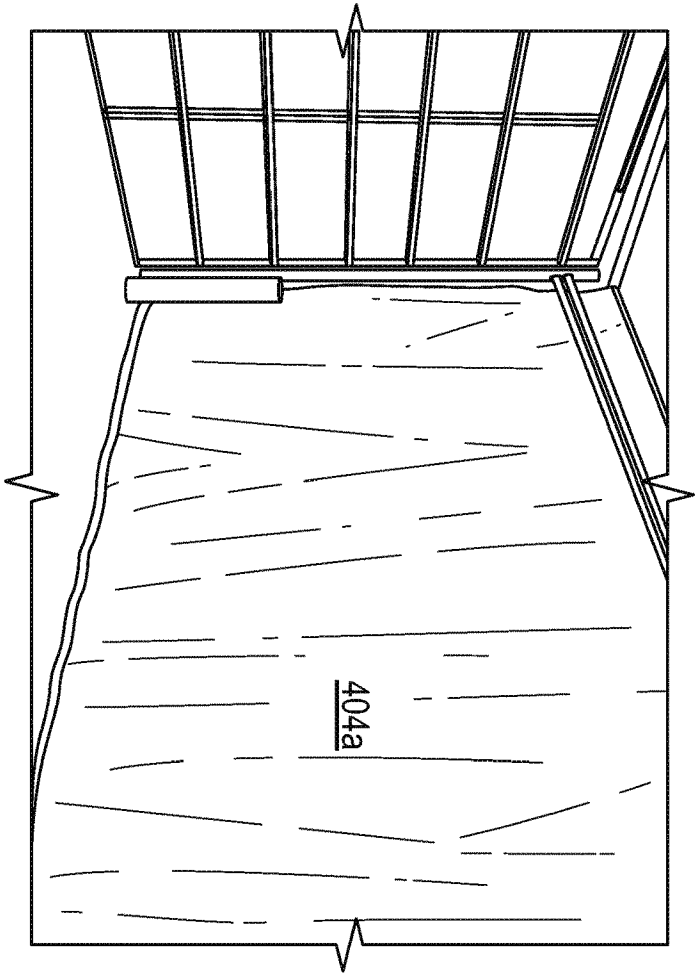
FIG. 4B illustrated the barrier of FIG. 4A in an expanded state.
Figure 5A:
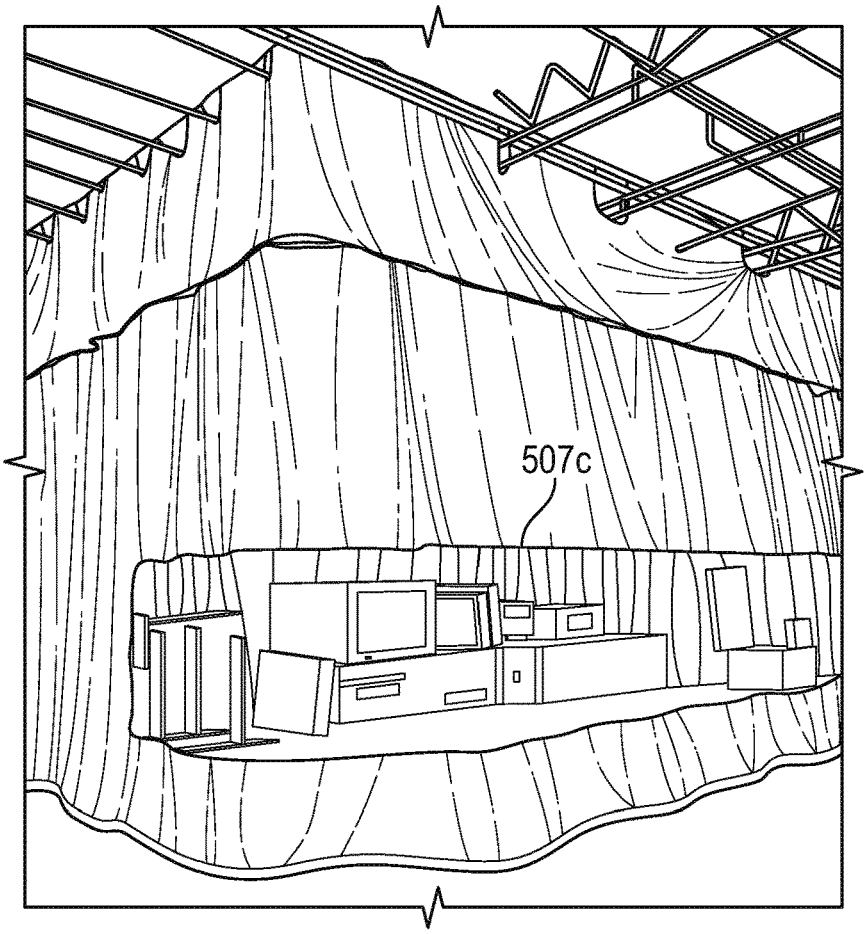
FIGS. 5A and 5B illustrate examples of a vision panel in accordance with certain aspects of the present disclosure.
Figure 5B:
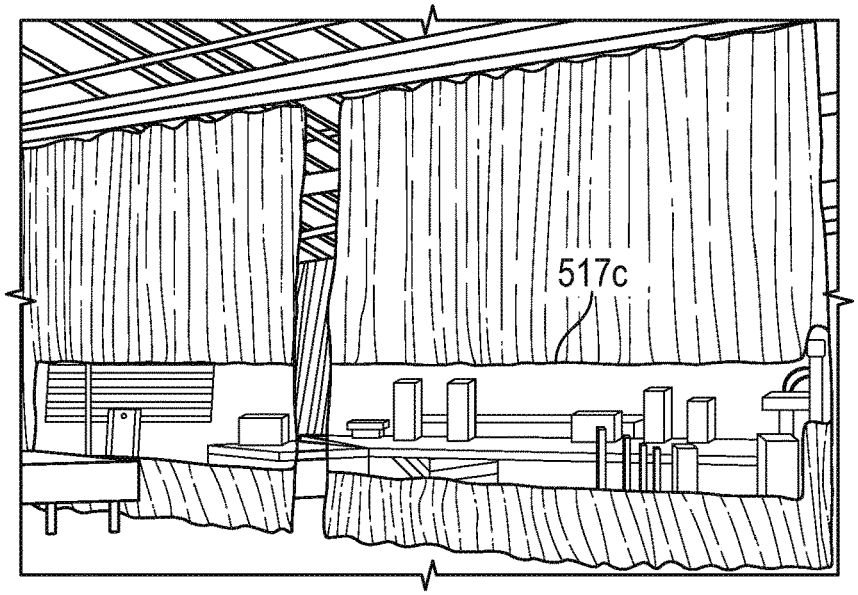

FIG. 4*a* illustrates an example barrier 404*a* that can be a retractable barrier that is in its retracted state. FIG. 4*b* illustrate barrier 404*a* in its extended state. FIGS. 5*a* and 5*b* illustrate example barriers that utilize a transparent or clear vision panel 507*c* and 517*c*.

Figure 6:
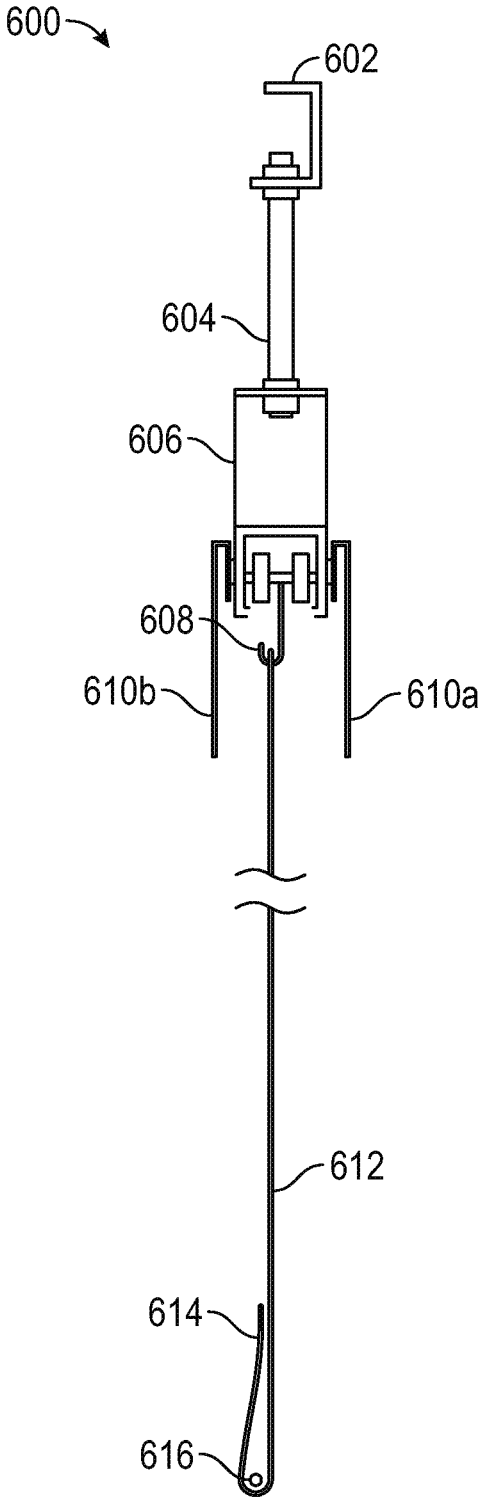
FIG. 6 illustrates an example trolley assembly in accordance with certain aspects of the present disclosure.

As described above, an NGV separation and containment system can utilize a track system to which one or more barriers may be attached and maintained statically and/or retracted/expanded. FIG. 6 illustrates an example track system 600 in accordance with one embodiment of the present disclosure. Track system 600 can include a clamp or other mechanism for attachment of track system 600 to, e.g., an existing roof/ceiling support element or member, such as a roof beam or other attachment point. It should be noted that other mechanism for mounting to a building or structure can be utilized in accordance with other embodiments. For example, track system 600 can be directly attached to a ceiling or roof surface/element in some embodiments.

Track system 600 may further include a rod 604 (which can be threaded with a locking nut at one end). Track system 600 may also comprise a track hanger bracket 606 with which a track (not shown) can be laid out in accordance with the desired area to be separated and/or contained. A trolley and hook assembly 608 can be drawn along the track to extend or retract a barrier.

Valances 610*a* and 610*b* can be configured to overlap main barrier 612. Valances 610*a* and 610*b* can serve to separate/contain, e.g., gasses from leaking out or escaping from an NGV service area via an area (including, e.g., the track and track and hook assembly 608) that would otherwise be "open." Main barrier 612 can a strip door barrier, a static barrier, a retractable barrier (such as those described above) or a barrier having any one or more combinations of such strip door, static, and retractable features. Valances 610*a*, 610*b* can attach to outer or inner surfaces of trolley and hook assembly, for example via some adhesive means (whether permanent or removable). Main barrier 612 can attach to trolley and hook assembly 608 by virtue of openings that can be hooked onto the hook portion of trolley and hook assembly 608. It should be noted that other known or future mechanisms/methods of attachment are contemplated so long as the requisite separation and/or contain of natural gas(ses) can be achieved. It should be noted that multiple trolley and hook assemblies can be utilized.

At a "bottom" portion of main barrier 612 (e.g., distal from the portion attached to trolley and hook assembly 608 can be doubled over and hemmed at 614. Within the hem, a chain or other weighting mechanism can be inserted or otherwise incorporated in order to keep main barrier 612 in an outspread or stretched fashion to effectuate the desired separation and containment within an NGV separation and containment system.

It should be noted that a separation and containment area, as contemplated in accordance with various embodiments may utilize a single barrier or multiple barriers. That is, in some embodiments, a single barrier may be used to enclose an entire service area. A door may implemented using the same barrier material on that single barrier. In other embodiments, multiple sections of barrier materials (described in greater detail below) may be used to, e.g., construct walls and/or door areas, etc. For example, a single section/piece of barrier material may be used as a wall barrier, while another barrier material may be used as a strip door. In other embodiments, each wall of a separation and containment system may be constructed using a second section/piece of barrier material (whether that barrier material is the same or different from the first).

As described above and in accordance with various embodiments, an NGV separation and containment system configured in accordance with various embodiments can utilize one or more barriers to provide separation and containment of an upgraded NGV service area within a larger building. As also described above, such barriers can include curtain-like barriers, strip doors, valances, as well as floor sweeps and filler panels (e.g., for providing additional containment/separation coverage that a "main barrier" may not be able to cover).

The barriers can be constructed out of a variety of materials that were previously not considered appropriate for use as a natural gas separation and/or containment capacity meeting the requisite codes/regulations set forth for NGV service facilities. In accordance with one embodiment, an 18 oz. polyvinylchloride (PVC) coated vinyl can be utilized to form or construct, e.g., curtain-like or wall barriers, valances, floor sweeps, and filler panels. It should be noted that other weights, e.g., heavier weight, PVC coated vinyl can also be utilized in accordance with other embodiments. It should be further noted that this PVC coated vinyl can be utilized in both CNG and LNG enclosures/service areas. In particular, the PVC coated vinyl material can have a weight of 18 oz. per square yard. The tensile strength can be about 375×375 pounds per inch. Moreover, this PVC coated vinyl can remain stable (e.g., remaining solid/unmelted or structurally sound) in constant temperatures of about 170° Fahrenheit (F), and can withstand cracking down to constant temperatures of about 30° F. The PVC coated vinyl can also withstand intermittent temperatures of about 200° F. Further still, the PVC coated vinyl meets or exceeds the following fire retardation standards: National Fire Protection Association (NFPA) 701, California State Fire Marshall (CSFM)-19 and American Society for Testing and Materials (ASTM) E-84 "Class A."

Another material that can be used as a floor sweep for LNG enclosures is urethane coated nylon that can have a weight of 32 oz. per square yard. Again, other weights, e.g., heavier weight, urethane coated nylon can also be utilized in accordance with other embodiments, such as a 49 oz. weight urethane coated nylon. The tensile strength can be about 700×700 pounds per inch. The urethane coated nylon can remain stable at continuous high temperatures of about 160° F. and intermittent high temperatures of about 180° F. Moreover, the urethane coated nylon can withstand a low temperature bend of about −60° F. Further still, the urethane coated nylon can remain stable when subjected to 30 seconds of immersion in about −206° F. liquid nitrogen. The aforementioned 49 oz. weight urethane coated nylon meets the Federal Motor Vehicle Safety Standards (FMVSS) Section 4.3 fire rating standard.

Another material that can be used for constructing CNG and LNG area divider curtains or viewing panels can be a 20 mil gauge clear PVC vinyl that can have a tensile strength of about 2,900-3,500 pounds per square inch (PSI)×260-300 PSI. The clear PVC vinyl can also withstand cold cracking down to about −20° F. and at least meets the minimum requirements established by the CSFM for products falling under section 13115 California (CA) Health and Safety, and MFPA-701 standards for fire resistance/retardation. Moreover, the clear PVC vinyl remains intact and structurally sound while experiencing no significant aesthetic or structural changes of the material after about a 30 minute exposure to methane (natural gas).

Still another material that can be used for the aforementioned strip doors for both CNG and LNG enclosures may be a 120 mil gauge clear PVC vinyl that has a tensile strength of about 2,400 PSI. It can withstand temperatures of about −33° F. before becoming brittle and can have an operating temperature range of about 0-150° F. Moreover, the 120 mil clear PVC vinyl can at least meet CSFM-19, section 1237.1 standards.

The aforementioned materials may be flexible, stretchable, or otherwise adaptable to contain one or more areas having a variety of shapes and/or dimensions while retaining the ability to contain one or more natural gasses (whether in gaseous or liquid form) and separate an area enclosed by the material(s) from another area.

Referring back to FIG. 6, the track and track hardware used for, e.g., hanging or otherwise attaching and maintaining the barriers/valances can be a pre-galvanized G-60 or better low carbon steel, and can be 10 gauge for any splices and/or mounting hardware, while 16 gauge pre-galvanized steel can be used for the track itself. The trolley portion of trolley and hook assembly 608 can utilize steel ball bearings as well as a zinc plated, cold finished round bar steel that can be hardened by carburization.

Various embodiments are described above as being utilized in the context of a conventional service area conversion/upgrade. However, various embodiments can be implemented in a stand-alone and/or original NGV-compliant service area. Moreover, various embodiments are not limited to use in an NGV context, but can be utilized in any scenario in which natural gasses should/must be kept separate and contained from one or more other environments. It should also be noted that the separation and containment system can be a part of a code compliant construction or upgrade plan.

Various embodiments, as alluded to previously, can allow for significant cost-savings when compared to the use of the aforementioned traditional constructions materials. Not only are these cost-savings realized in terms of the cost of materials, but also in the costs associated with laborers. That is, constructing conventional containment systems may require multiple types of laborers, whereas erecting a separation and containment system in accordance with various embodiments may require only a single type of laborer. The time to erect or construct a separation and containment system in accordance with various embodiments may also be significantly shorter when compared to service areas that are upgraded in accordance with conventional methods, e.g., days in accordance with various embodiments versus several weeks (at the least) for conventional systems. Moreover, the materials used, e.g., one or more of the aforementioned barriers and track systems can be reused, relocated, etc.

While various embodiments have been described above, it should be understood that they have been presented by way of example only, and not of limitation. Likewise, the various diagrams may depict an example architectural or other configuration for various embodiments, which is done to aid in understanding the features and functionality that can be included. Various embodiments are not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of various embodiments. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the present disclosure discloses various example embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A separation and containment system comprising:

at least one adaptable barrier that separates one or more natural gases comprising at least one compressed natural gas or at least one liquefied natural gas contained within a first area from at least one second area;

a track system comprising a trolley assembly to which the at least one adaptable barrier is attached, the track system configured to be resizable for adaptation to changing dimensions of a first service area;

a first valance and a second valance, each of the first and second valances overlapping at least one portion of the at least one adaptable barrier at at least one point of attachment of the at least one adaptable barrier to the trolley assembly, such that each of the first and second valances are covering a space created by the at least one adaptable barrier attached to the trolley assembly at the at least one attachment point of the at least one adaptable barrier to the track system and to prevent the one or more natural gases from exiting the first area via the at least one attachment point; and at least one static barrier that separates one or more natural gases comprising at least one compressed natural gas or at least one liquefied natural gas contained within the first area from the at least one second area;

wherein the first area is configured for servicing natural gas vehicles (NGVs) and the at least one second area is configured for servicing vehicles utilizing petroleum-based fuel;

wherein the at least one adaptable barrier comprises a polyvinylchloride (PVC) coated vinyl.

2. The separation and containment system of claim 1, wherein the at least one adaptable barrier is retractable and expandable along one or more sections of the track system.

3. The separation and containment system of claim 1, wherein the at least one adaptable barrier is selected from the group consisting of: a curtain, a valance, a strip door, and a filler panel.

4. The separation and containment system of claim 3, wherein the strip door comprises a clear PVC vinyl having the following material characteristics:

a gauge of about 120 mil;

a tensile strength of about 2,400 pounds per square inch;

brittleness resistance down to about −33 degrees Fahrenheit; and capable of operating temperatures from about 0 to 150 degrees Fahrenheit.

5. The separation and containment system of claim 1, wherein the PVC coated vinyl has the following material characteristics:

a weight of at least 18 ounces per square yard;

a grab tensile strength of about 375×375 pounds per 1 inch;

constant temperature resistance up to about 170 degrees Fahrenheit and down to about 30 degrees Fahrenheit; and intermittent temperature resistance up to about 200 degrees Fahrenheit.

6. The separation and containment system of claim 1, wherein the at least one adaptable barrier comprises a divider curtain.

7. The separation and containment system of claim 6, wherein the divider curtain comprises a clear PVC vinyl having the following material characteristics:

a gauge of at least 20 mil;

a tensile strength of about 2,900-3,500 pounds per square inch×260-300 pounds per square inch; and cold crack resistance to about −20 degrees Fahrenheit.

8. The separation and containment system of claim 1, wherein the track system comprises a track and mounting hardware.

9. The separation and containment system of claim 8, wherein the track and mounting hardware comprise pre-galvanized low carbon steel having at least a G-60 coating weight.

10. The separation and containment system of claim 1, wherein the trolley assembly comprises steel ball bearings in a roller mechanism of the trolley assembly and a zinc plated cold finished round bar steel hardened by carburization to which the at least one adaptable barrier is attached.

11. The separation and containment system of claim 1, wherein the at least one adaptable barrier and the track system are resizable for adaptation to changing dimensions of the first service area.

* * * * *